US007908136B2

(12) United States Patent
Zhang et al.

(10) Patent No.: US 7,908,136 B2
(45) **Date of Patent: *Mar. 15, 2011**

(54) FIXED CODEBOOK SEARCH METHOD AND SEARCHER

(75) Inventors: Dejun Zhang, Shenzhen (CN); Liang Zhang, Shenzhen (CN); Lixiong Li, Shenzhen (CN); Tinghong Wang, Shenzhen (CN); Yue Lang, Shenzhen (CN); Wenhai Wu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/838,229

(22) Filed: Jul. 16, 2010

(65) Prior Publication Data

US 2010/0274559 A1 Oct. 28, 2010

Related U.S. Application Data

(63) Continuation of application No. 12/777,875, filed on May 11, 2010, which is a continuation of application No. PCT/CN2008/072920, filed on Nov. 4, 2008.

(30) Foreign Application Priority Data

Nov. 12, 2007 (CN) ..... 2007 1 0124503

(51) Int. Cl.
*G10L 19/12* (2006.01)

(52) U.S. Cl. ..... 704/221; 704/222; 704/223

(58) Field of Classification Search ..... 704/221, 704/222, 223

See application file for complete search history.

(56) References Cited

U.S. PATENT DOCUMENTS

| | | | | |
|---|---|---|---|---|
| 6,029,128 | A | 2/2000 | Jarvinen et al. | |
| 7,206,739 | B2 | 4/2007 | Lee | |
| 2003/0033136 | A1 | 2/2003 | Lee | |
| 2004/0193410 | A1 | 9/2004 | Lee et al. | |
| 2005/0256702 | A1 | 11/2005 | Vadapalli | |
| 2006/0074641 | A1 | 4/2006 | Goudar et al. | |
| 2006/0149540 | A1 * | 7/2006 | Singh et al. | 704/223 |
| 2007/0016410 | A1 * | 1/2007 | Sung et al. | 704/223 |
| 2007/0043560 | A1 | 2/2007 | Lee | |
| 2009/0164211 | A1 * | 6/2009 | Morii | 704/223 |

(Continued)

FOREIGN PATENT DOCUMENTS

CN 1440200 A 9/2003

(Continued)

OTHER PUBLICATIONS

Lee, E.D., et al., "Iteration-free pulse replacement method for algebraic codebook search," Electronics Letters, vol. 43, No. 1, Jan. 4, 2007, 2 pages.

(Continued)

*Primary Examiner* — Qi Han
(74) *Attorney, Agent, or Firm* — Slater & Matsil, L.L.P.

(57) ABSTRACT

A fixed codebook search method includes initializing a counter, searching for pulses and calculating the value of a cost function Qk, initializing the counter if the Qk value increases, increasing the value of the counter if the Qk value does not increase, judging whether the value of the counter is greater than the threshold value, continuing the search process if the value of the counter is not greater than the threshold value, and ending the whole search process if the value of the counter is greater than the threshold value.

12 Claims, 7 Drawing Sheets

U.S. PATENT DOCUMENTS

| | | | | |
|---|---|---|---|---|
| 2009/0240493 | A1 | 9/2009 | Zhang et al. | |
| 2009/0240494 | A1 * | 9/2009 | Morii | 704/223 |
| 2010/0088091 | A1 | 4/2010 | Lee et al. | |

FOREIGN PATENT DOCUMENTS

| | | | |
|---|---|---|---|
| CN | 1652207 | A | 8/2005 |
| CN | 1760975 | A | 4/2006 |
| CN | 1766988 | A | 5/2006 |
| CN | 1811917 | A | 8/2006 |
| EP | 2 101 321 | A1 | 9/2009 |
| JP | 2002-366199 | A | 12/2002 |
| KR | 2001-0076622 | A | 8/2001 |
| WO | WO 2008/044817 | A1 | 4/2008 |
| WO | WO 2009/006819 | A1 | 1/2009 |

OTHER PUBLICATIONS

Chinese Office Action, Application No. 200710124503.X, Dated May 8, 2009, 9 pages.

* cited by examiner

FIXED CODEBOOK SEARCH METHOD AND SEARCHER

This application is a continuation of U.S. patent application Ser. No. 12/777,875, filed on May 11, 2010, which is a continuation of International Application No. PCT/CN2008/072920, filed on Nov. 4, 2008, which claims priority to Chinese Patent Application No. 200710124503.X, filed on Nov. 12, 2007, all of which are hereby incorporated by reference in their entireties.

TECHNICAL FIELD

The present invention relates to information technologies, and in particular, to a fixed codebook search method and a searcher.

BACKGROUND

In the voice coding field, the voice coder based on the Code Excited Linear Prediction (CELP) model is the most widely applicable. As against other voice coders such as a waveform coder and a parameter coder, the CELP-based voice coder accomplishes high voice quality in the case of very low code rates, and still shows excellent performance in the case of high code rates. The CELP-based voice coder uses codebook as an excitation source, and is characterized by low rates, high quality of synthesized voice, high resistance to noise, and high performance of multiple audio transfer operations. The adaptive codebooks and fixed codebooks serving as excitation signals play a very important role in the CELP coder. The function of an adaptive filter is to remove the Long Range Dependence (LRD) from the residual voice signals. After the LRD is removed, the residual voice signals are similar to white noise (quasi-white noise), which is not suitable for precise quantization. Currently, the target signals of fixed codebooks are generally quantized effectively through (1) random codebook method; (2) regular pulse method; (3) auto-correlation algorithm; (4) transform domain algorithm; or (5) algebraic codebook method. These methods have their own characteristics, and fully use the features of fixed codebooks to quantize the signals, but have their defects in terms of quality of voice synthesis, quantity of occupied bits, and complexity of computation. The method widely applied at present is the algebraic codebook method, which has many merits unavailable from other methods. The algebraic codebook method cares about the pulse position of a fixed codebook for the target signal and regards the pulse amplitude as 1 by default. In this way, massive multiplication computation is converted into addition and subtraction computation, and the computation complexity is reduced drastically. Moreover, only the symbol and position of the pulse need to be quantized; the bits required for quantization are reduced; and high voice quality is ensured. However, at the time of searching for the best position of the pulse, a huge computation load is involved in the full search, and real-time search is impossible when there are many pulses. Therefore, a suboptimal search algorithm is required. The quality of the finally synthesized voice depends on the quality of the suboptimal search algorithm directly. Therefore, the search algorithm is vital to calculating the codebook.

A fixed codebook search method in the prior art includes the following steps:

(1) Obtain the initial codebook for pulse search.

(2) The fixed codebook searcher determines the pulse group (supposing that the group includes n pulses), and the pulse group includes at least one initial codebook pulse.

(3) Select m tracks among several tracks randomly, replace the positions of the pulses in the pulse group selected above with other positions in the m tracks, and calculate the value of the cost function Qk.

(4) Select tracks randomly for several times, and substitute the pulse group position that increases the Qk value maximally in the selected tracks for the positions of the corresponding pulses in the initial codebook.

(5) After the pulses in a pulse group are replaced, fix the pulse position of this pulse group, and substitute the pulses on other tracks for the remaining pulses in the initial codebook through step (3) and step (4).

(6) This process can be repeated.

The foregoing search method in the prior art involves very low complexity of computation, allows for the correlation between pulses, and provides high performance. However, the count of cyclic searches is fixed, which leads to a low computation efficiency of searching.

Another fixed codebook search method is provided in the prior art. This method has the following features: (1) providing similar performance as the standard method in the case of a small search count; and (2) being applicable to coders of any ACELP fixed codebook structure, and imposing no special requirements on the pulse position and the track structure. This search method includes: (a) calculating the absolute value of the likelihood function of the pulse position, to obtain the information about the position where a pulse may exist; (b) obtaining a codebook vector temporarily as an initial codebook; (c) replacing a pulse in the initial codebook, and calculating the cost function Qk; (d) judging whether the Qk value of the codebook increases after the replacement; (e) if the Qk value increases, using the new pulse to replace the old pulse from the initial codebook to obtain a new codebook; and (f) if the Qk value decreases, still using the existing codebook.

This search method is also characterized by a fixed count of cyclic searches, and also provides a low efficiency of computation.

SUMMARY OF THE INVENTION

An efficient fixed codebook search method and a fixed codebook searcher are provided in various embodiments of the present invention to reduce the search times and to improve the search efficiency.

A fixed codebook search method provided in an embodiment of the present invention includes: initializing a counter; searching for pulses and calculating the value of a cost function Qk; initializing the counter to an initial value if the value of Qk increases; increasing the value of the counter if the value of Qk does not increase; and ending the whole search process when the value of the counter is greater than a threshold value.

Another fixed codebook search method provided in an embodiment of the present invention includes: setting an initial state flag; searching for pulses and calculating the value of a cost function Qk; modifying the state flag to a non-initial state if the value of Qk increases; and ending the whole search process if the state flag indicates the initial state.

A fixed codebook searcher provided in an embodiment of the present invention includes: a pulse searching unit configured to search for pulses; a counter configured to initialize the counter to an initial value if the value of Qk increases and to increase the value of the counter if the value of Qk does not increase; and a judging unit configured to judge whether the value of the counter is greater than a threshold value.

The pulse searching unit ends the whole search process if the judging unit determines that the value of the counter is greater than the threshold value.

Another fixed codebook searcher provided in an embodiment of the present invention includes: a pulse searching unit configured to search for pulses; an identifying unit configured to set an initial state flag and update the state flag to a non-initial state when the Qk value increases; and a judging unit configured to judge whether the identifying unit indicates the initial state.

The pulse searching unit ends the whole search process if the judging unit determines that the identifying unit indicates the initial state.

In the technical solution under the present invention, the counter or the identifying unit records the count of searches in which Qk increases or does not increase. Therefore, the search iteration stops when the preset conditions are fulfilled, thus reducing the search count and improving the search efficiency.

DETAILED DESCRIPTION OF ILLUSTRATIVE EMBODIMENTS

Embodiment One

Figure 1:
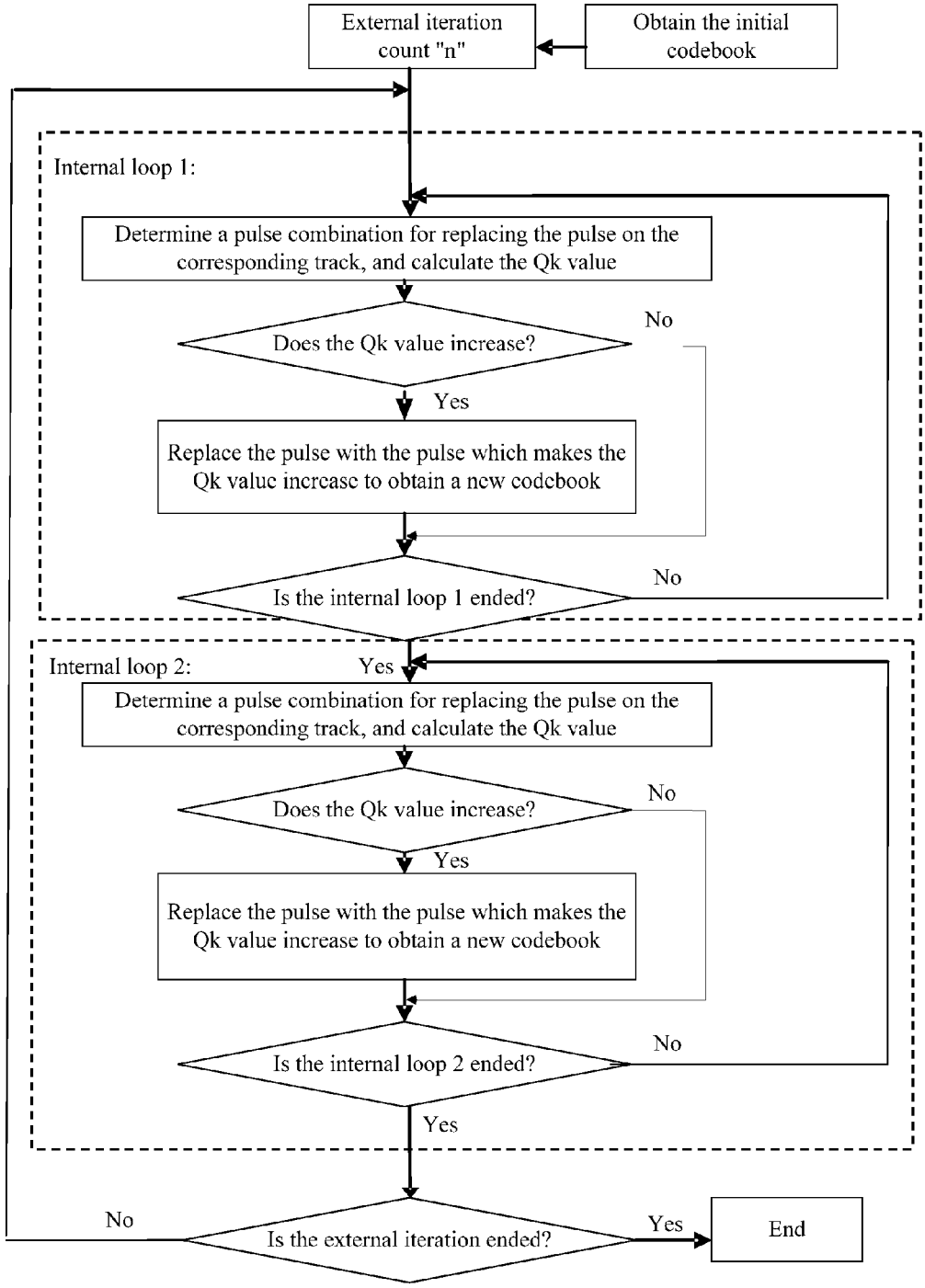
FIG. 1 (PRIOR ART)
FIG. 1 is a flowchart of a fixed codebook search method in the prior art.
Figure 2:
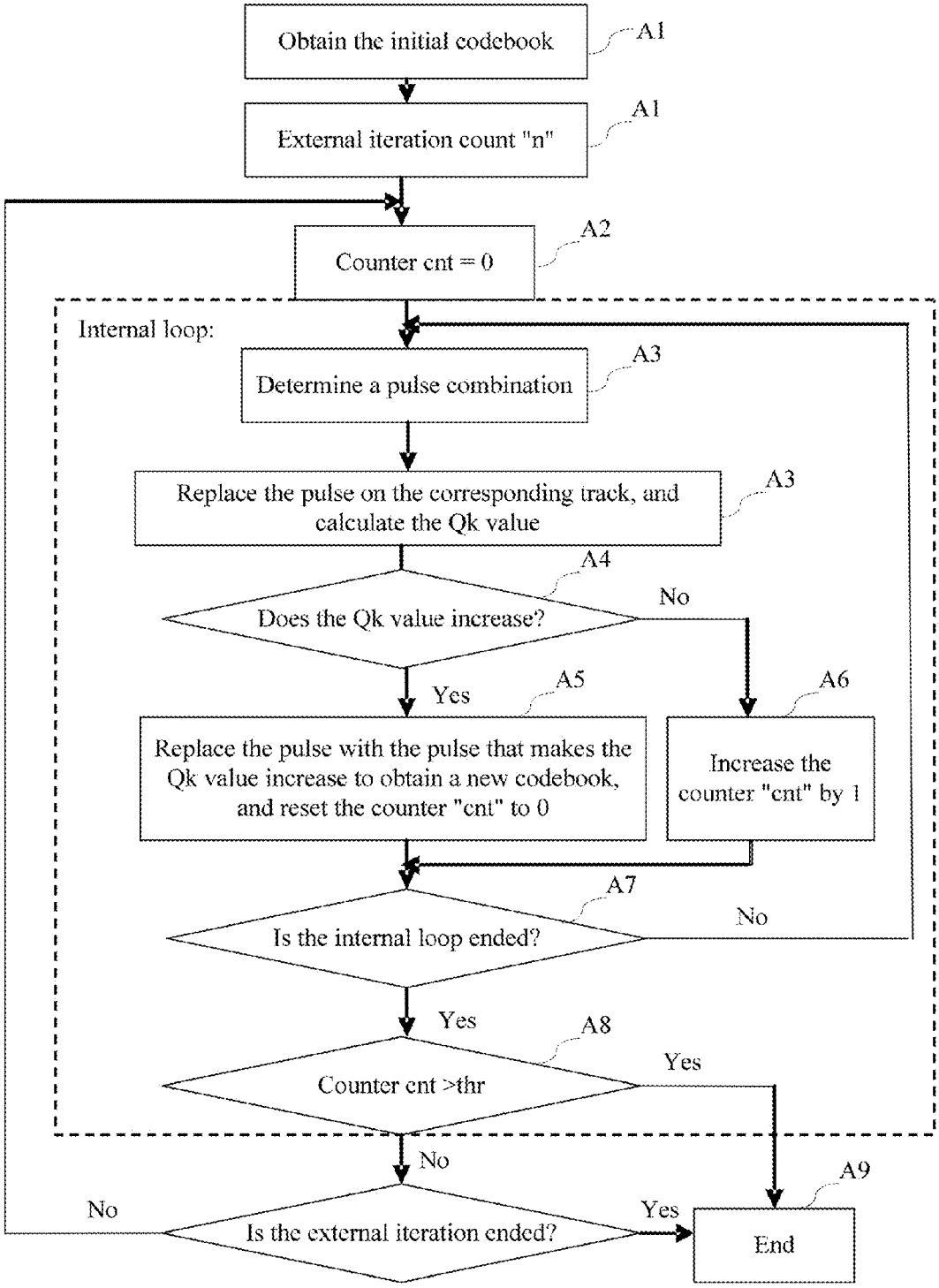
FIG. 2 is a flowchart of a fixed codebook search method according to Embodiment One of the present invention.

As shown in FIG. 2, the fixed codebook search method in this embodiment includes the following steps:

A1. Obtain the initial codebook, and set the external iteration count "n".

For ease of understanding, assume that only one pulse exists on each track, and the pulses are: P0, P1, P2, and P3. Assume that the initial codebook is {i0, i1, i2, i3}={20, 33, 42, 7}. The enclosed numerals indicate the pulse position. Table 1 shows the codebook structure.

TABLE 1

| Codebook structure | | |
|---|---|---|
| Track (Tx) | Pulse | Positions |
| 1(T0) | P0 | 0, 4, 8, 12, 16, 20, 24, 28, 32 36, 40, 44, 48, 52, 56, 60 |
| 2(T1) | P1 | 1, 5, 9, 13, 17, 21, 25, 29, 33, 37, 41, 45, 49, 53, 57, 61 |
| 3(T2) | P2 | 2, 6, 10, 14, 18, 22, 26, 30, 34, 38, 42, 46, 50, 54, 58, 62 |
| 4(T3) | P3 | 3, 7, 11, 15, 19, 23, 27, 31, 35, 39, 43, 47, 51, 55, 59, 63 |

This embodiment does not limit the method of obtaining the initial codebook. In one embodiment, the initial codebook may be obtained through the "maximum likelihood function of pulse position".

A2. Initialize the counter to 0 or −1, or another fixed value. The counter is used to record the count of continuous searches when pulse replacements do not happen. The pulse replacement is: When the Qk value increases, the original pulse combination is replaced with the pulse combination that makes the Qk value increase.

A3. Search for pulses and calculate the Qk value. Specifically, determine a pulse combination, replace the pulses with the pulse combination on the corresponding track, and calculate the corresponding Qk value. This embodiment does not limit the pulse search method. For example, the pulses may be searched out in the following way.

Taking the global pulse replacement as an example, the pulse search method is as follows.

Keep the i1, i2, i3 positions in the initial codebook unchanged; replace the initial value 20 of i0 with value of other position from track T0 {0, 4, 8, 12, 16, 24, 28, 32 36, 40, 44, 48, 52, 56, 60} one by one, to obtain new codebook {0, 33, 42, 7}, {4, 33, 42, 7}, . . . {60, 33, 42, 7}; and calculate the cost of the new codebook Qk. The process of pulse search of different pulse positions on the selected track is an internal iteration search.

A4. Judge the Qk value. Judge whether the Qk value increases. If the Qk value increases, proceed to step A5; otherwise, go to step A6.

A5. Replace the original pulses with the pulses that make the Qk value increase to obtain a new codebook, and reset the counter to the initial value.

If the new Qk value is greater than the Qk value of the initial codebook, replace the initial codebook with the new codebook, and use the new codebook as an initial codebook. Assume that the Qk corresponding to {4, 33, 42, 7} is the maximum Qk in the replacement process described above. Store the Qk value "Y0" and the corresponding new codebook {4, 33, 42, 7}.

A6. Increment the counter value "cnt". Specifically, the counter value "cnt" may be increased by 1.

A7. Judge whether the internal iteration search is ended. If the internal iteration search is not ended, return to step A3; if the internal iteration search is ended, proceed to step A8.

A8. Judge whether the counter value is greater than the threshold value. If the counter value is greater than the threshold value, proceed to step A9; if the counter value is not greater than the threshold value, continue the search process. If the external iteration search is not ended, return to step A2. Search the next track, that is, repeat steps A2, A3, A4, and A5 until all the four tracks T0-T3 are searched completely, whereupon the whole process is ended. Selecting different tracks for searching, as described above, is called "external iteration search". The foregoing threshold value may be set as required. If the internal iteration count is a, the threshold value may be a multiple of a, or a−1, or a+1, and so on.

A9. End the whole search process.

Alternatively, the counter may be initialized before the external iteration search.

If the counter value "cnt" exceeds the threshold value "thr", it indicates that no pulse replacement occurs within the threshold count, that is, no better pulse combination is found. In this case, it is deemed that the best pulse has been found, and the whole search process is ended.

Embodiment Two

Figure 3:
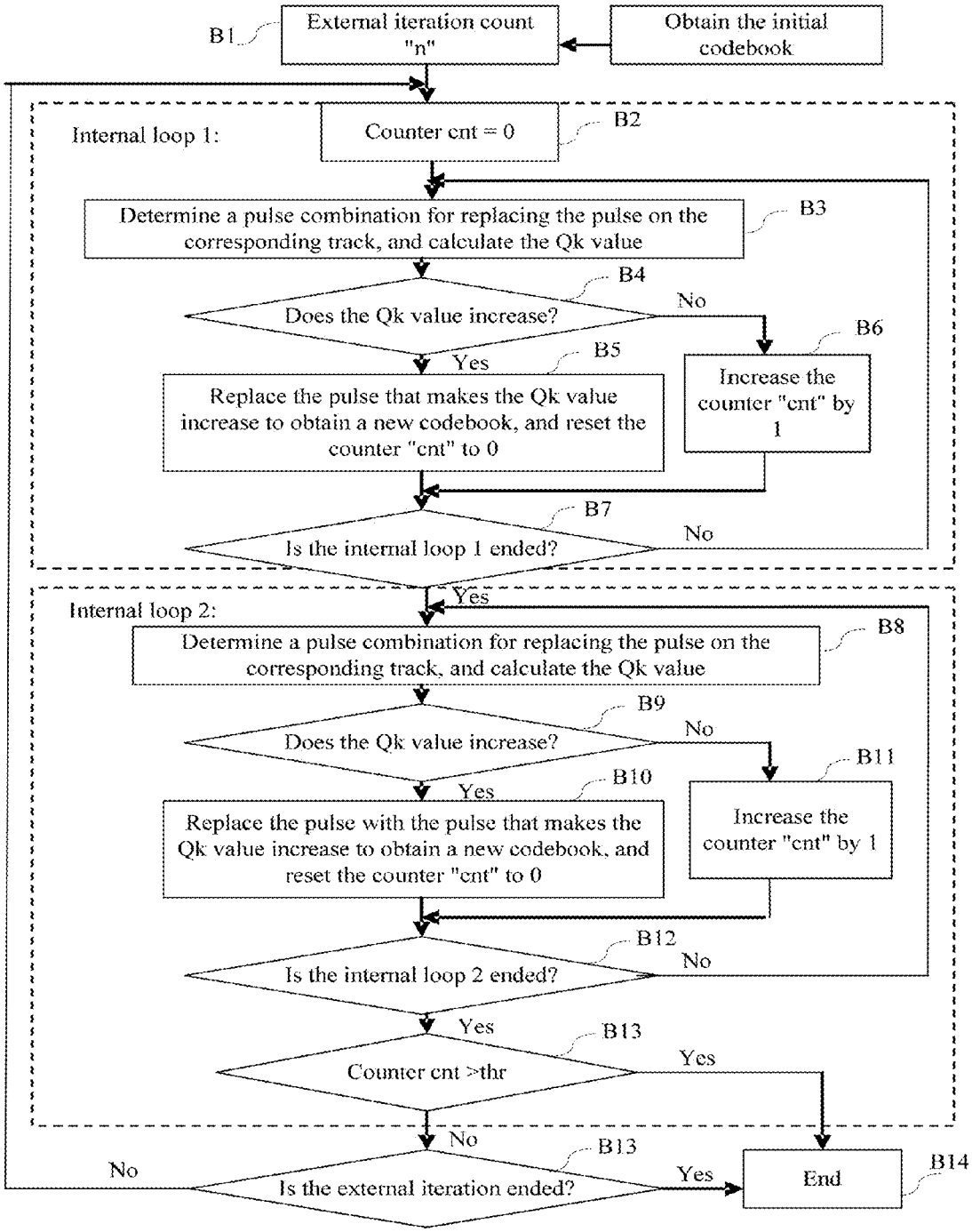
FIG. 3 is a flowchart of a fixed codebook search method according to Embodiment Two of the present invention.

Another fixed codebook search method embodiment is provided. As shown in FIG. 3, this embodiment differs from the first embodiment in that two internal loops (for example, internal loop 1 and internal loop 2) are nested in an external loop. Multiple internal loops may be nested. The specific process of this embodiment is as follows.

B1. Obtain the initial codebook, and set the external iteration count "n".

B2. Initialize the counter value "cnt".

The counter may be initialized before the external iteration search, or before the internal iteration search.

B3. Search for pulses in the internal loop 1, and calculate Qk value. Replace the pulses with a new pulse combination on the corresponding track, and calculate the corresponding Qk value.

B4. Judge the Qk value. Judge whether the Qk value increases. If the Qk value increases, proceed to step B5; otherwise, go to step B6.

B5. Replace the original pulses with the pulses that make the Qk value increase to obtain a new codebook, and reset the counter "cnt" to the initial value.

B6. Increment the counter value "cnt". Specifically, the counter value "cnt" may be increased by 1.

B7. Judge whether the internal loop 1 search is ended. If the internal loop 1 search is not ended, return to step B3; if the internal loop 1 search is ended, proceed to step B8.

B8. Search for pulses in the internal loop 2, and calculate the corresponding Qk value. Replace the pulses with a new pulse combination on the corresponding track, and calculate the Qk value.

B9. Judge the Qk value. Judge whether the Qk value increases. If the Qk value increases, proceed to step B10; otherwise, go to step B11.

B10. Replace the original pulses with the pulses that make the Qk value increase to obtain a new codebook, and reset the counter to the initial value.

B11. Increment the counter value "cnt". Specifically, the counter value "cnt" may be increased by 1.

B12. Judge whether the internal loop 2 search is ended. If the internal loop 2 search is not ended, return to step B8; if the internal loop 2 search is ended, proceed to step B13.

B13. Judge whether the counter value "cnt" is greater than the threshold value. If the counter value "cnt" is greater than the threshold value, proceed to step B14; otherwise, continue the search process. If the external loop is not ended, return to step B2.

B14. End the whole search process.

Embodiment Three

Figure 4:
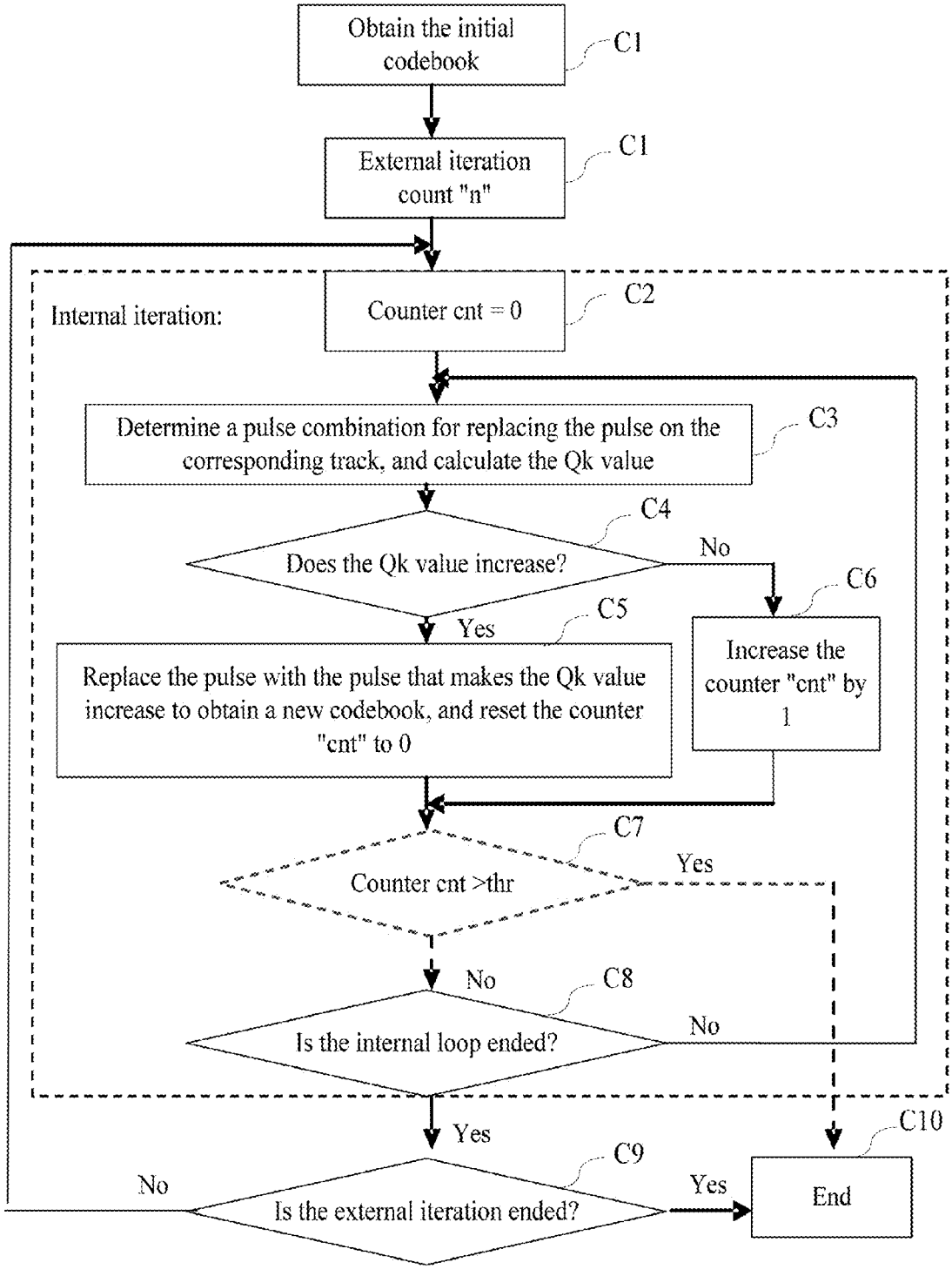
FIG. 4 is a flowchart of a fixed codebook search method according to Embodiment Three of the present invention.

Another fixed codebook search method is provided in this embodiment. As shown in FIG. 4, this embodiment differs from the first embodiment in that a judgment is made about whether the internal loop is ended after a judgment is made about whether the value of the counter "cnt" is greater than the threshold value.

The specific steps of this embodiment are as follows:

C1. Obtain the initial codebook, and set the external iteration count "n".

C2. Initialize the counter "cnt".

C3. Search for pulses, and calculate the Qk value. Determine a pulse combination, replace the pulses with the pulse combination on the corresponding track, and calculate the Qk value.

C4. Judge the Qk value. Judge whether the Qk value increases. If the Qk value increases, proceed to step C5; otherwise, go to step C6.

C5. Replace the original pulses with the pulses that make the Qk value increase to obtain a new codebook, and reset the counter to the initial value.

C6. Increment the counter "cnt". Specifically, the counter "cnt" may be increased by 1.

C7. Judge whether the value of the counter "cnt" is greater than the threshold value. If the value of the counter "cnt" is greater than the threshold value, go to step C10; otherwise, proceed to step C8.

C8. Judge whether the internal loop search is ended. If the internal loop search is not ended, return to step C3; if the internal loop search is ended, proceed to step C9.

C9. Judge whether the external iteration search is ended. If the external iteration search is not ended, return to step C2; if the external iteration search is ended, proceed to step C10.

C10. End the whole search process.

Embodiment Four

Figure 5:
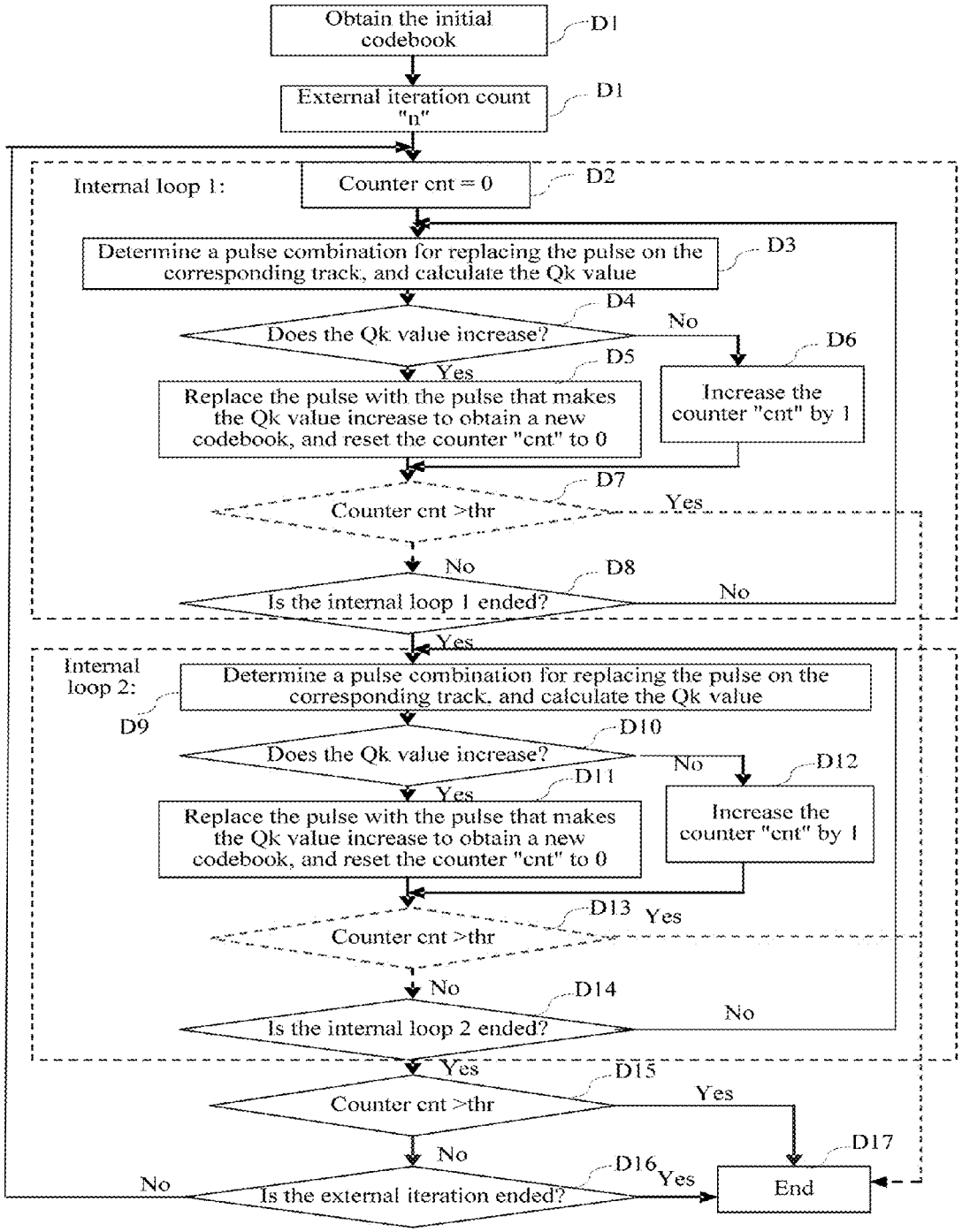
FIG. 5 is a flowchart of a fixed codebook search method according to Embodiment Four of the present invention.

Another fixed codebook search method is provided in this embodiment. As shown in FIG. 5, this embodiment differs from the third embodiment in that two internal loops (namely, internal loop 1 and internal loop 2) are nested in an external loop, and a judgment is made about whether the value of the counter "cnt" is greater than the threshold value before the end of each internal loop. Multiple internal loops may be nested. Optionally, a judgment is made about whether the value of the counter "cnt" is greater than the threshold value after the end of the internal loop.

The specific steps of this embodiment are as follows:

D1. Determine the initial codebook, and set the external iteration count "n".

D2. Initialize the counter value "cnt".

D3. Search for pulses in the internal loop 1, and calculate the Qk value. Replace the pulses with a new pulse combination on the corresponding track, and calculate the Qk value.

D4. Judge the Qk value. Judge whether the Qk value increases. If the Qk value increases, proceed to step D5; otherwise, go to step D6.

D5. Replace the original pulses with the pulses that make the Qk value increase to obtain a new codebook, and reset the counter "cnt" to the initial value.

D6. Increment the counter value "cnt". Specifically, the counter value "cnt" may be increased by 1.

D7. Judge whether the value of the counter "cnt" is greater than the threshold value. If the value of the counter "cnt" is greater than the threshold value, go to step D17; otherwise, proceed to step D8.

D8. Judge whether the internal loop 1 is ended. If the internal loop 1 is not ended, return to step D3; if the internal loop 1 is ended, proceed to step D9.

D9. Search for pulses in the internal loop 2, and calculate the Qk value. Replace the pulses with the new pulse combination on the corresponding track, and calculate the Qk value.

D10. Judge the Qk value. Judge whether the Qk value increases. If the Qk value increases, proceed to step D11; otherwise, go to step D12.

D11. Replace the original pulses with the pulses that make the Qk value increase to obtain a new codebook, and reset the counter "cnt" to the initial value.

D12. Increment the counter value "cnt". Specifically, the counter value "cnt" may be increased by 1.

D13. Judge whether the value of the counter "cnt" is greater than the threshold value. If the value of the counter "cnt" is greater than the threshold value, proceed to step D17; otherwise, proceed to step D14.

D14. Judge whether the internal loop 2 is ended. If the internal loop 2 is not ended, return to step D9; if the internal loop 2 is ended, proceed to step D15.

D15. Judge whether the value of the counter "cnt" is greater than the threshold value. If the value of the counter "cnt" is greater than the threshold value, go to step D17; otherwise, proceed to step D16.

D16. Judge whether the external iteration is ended. If the external iteration is not ended, return to step D2; if the external iteration is ended, proceed to step D17.

D17. End the whole search process.

Embodiment Five

Figure 6:
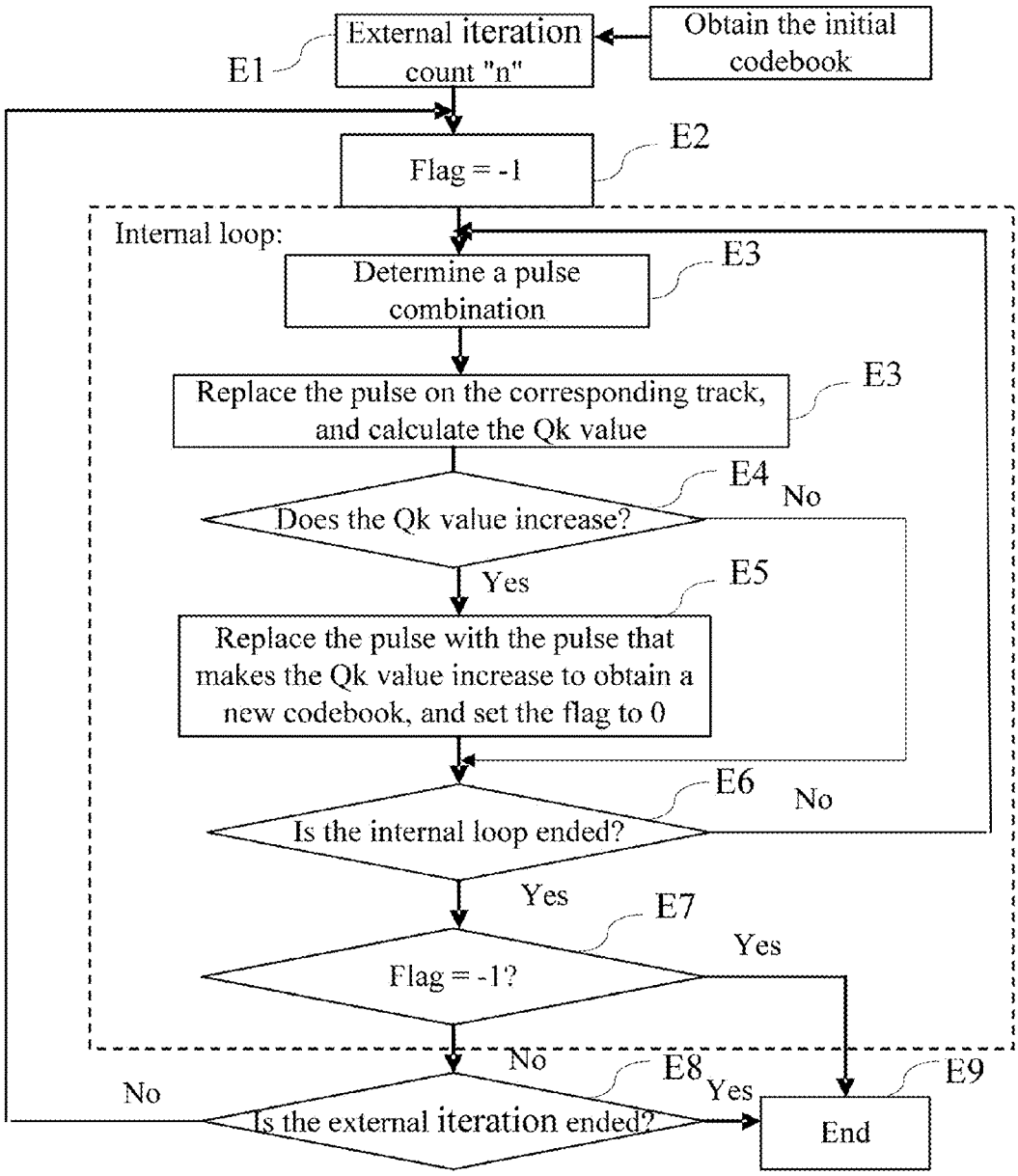
FIG. 6 is a flowchart of a fixed codebook search method according to Embodiment Five of the present invention.

Another fixed codebook search method is provided in this embodiment. As shown in FIG. 6, a flag is set to indicate whether a better pulse combination appears in a loop; if a better pulse combination appears, the flag is set to 0; otherwise, the flag value is still −1. Before end of a loop, a judgment is made about whether the flag value is 0; if the flag value is 0, it indicates that a better pulse combination appears in a cyclic replacement process, and the flag value is reset to −1 and a new replacement loop begins. The foregoing process is repeated.

The specific steps of this embodiment are as follows.

E1. Determine the initial codebook, and set the external iteration count "n".

E2. Initialize the state flag. Set an initial state value, such as −1, 0, or 1.

E3. Search for pulses in the internal iteration, and calculate the Qk value. Replace the pulse with a new pulse combination on the corresponding track, and calculate the Qk value.

E4. Judge the Qk value. Judge whether the Qk value increases. If the Qk value increases, proceed to step E5. If the Qk value does not increase, proceed to step E6.

E5. Replace the pulse with the pulse combination that makes the Qk value increase to obtain a new codebook. Modify the state flag to a non-initial state which is different from the initial state value.

E6. Judge whether the internal iteration is ended. If the internal iteration is not ended, return to step E3; if the internal iteration is ended, proceed to step E7.

E7. Judge whether the state flag indicates the initial state. If the state flag does not indicate the initial state, proceed to step E8; if the state flag indicates the initial state, go to step E9.

E8. Judge whether the external iteration is ended. If the external iteration is not ended, return to step E2; if the external iteration is ended, proceed to step E9.

E9. End the whole search process.

Embodiment Six

Figure 7:
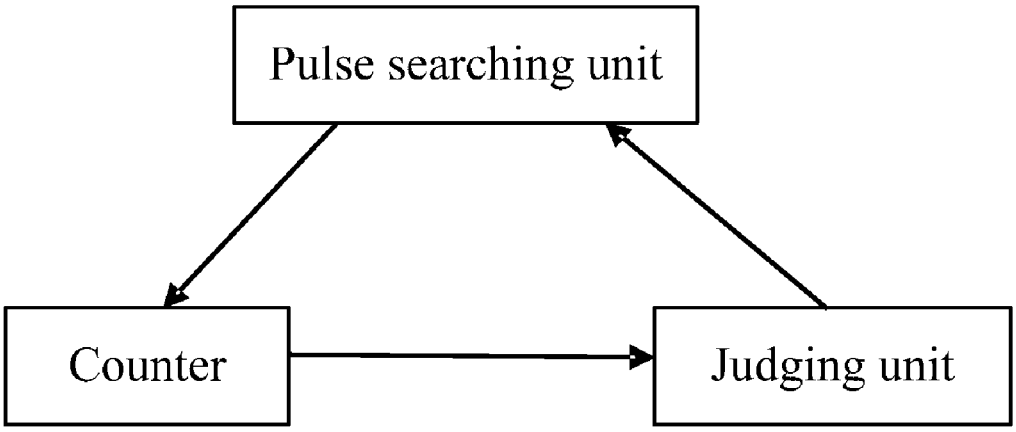
FIG. 7 shows a structure of a fixed codebook searcher according to Embodiment Six of the present invention.

A fixed codebook searcher is provided in this embodiment. As shown in FIG. 7, the fixed codebook searcher includes: a pulse searching unit configured to search for pulses; a counter configured to be initialized if the value of Qk increases and to increase the value of the counter if the value of Qk does not increase; and a judging unit configured to end the whole search process when the value of the counter is greater than a threshold value.

Embodiment Seven

Figure 8:
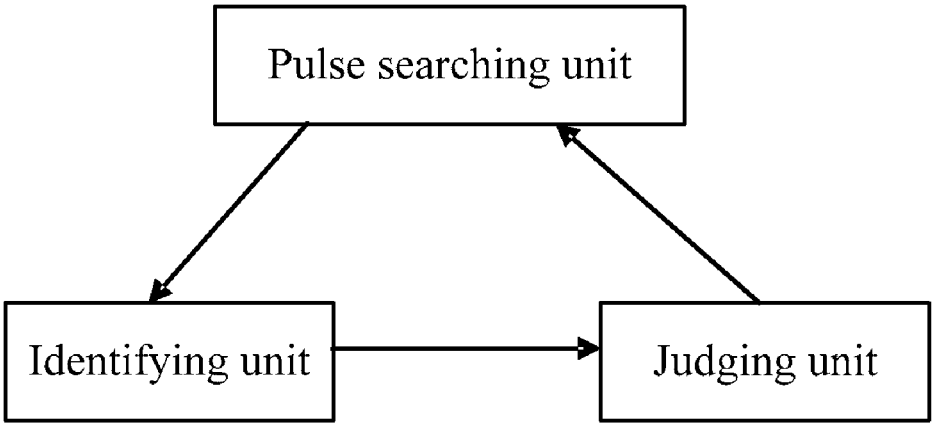
FIG. 8 shows a structure of a fixed codebook searcher according to Embodiment Seven of the present invention.

Another fixed codebook searcher is provided in this embodiment. As shown in FIG. 8, the fixed codebook searcher includes: a pulse searching unit configured to search for pulses; an identifying unit configured to identify the initial state and to set the state flag to a non-initial state when the Qk value increases; and a judging unit configured to judge whether the identifying unit indicates the initial state and to end the whole search process if determines that the identifying unit indicates the initial state.

Through the foregoing method or apparatus, the counter or the identifying unit records the count of searches in which Qk increases or does not increase. Therefore, the search iteration stops when the preset conditions are fulfilled, thus reducing the search count and improving the search efficiency.

Detailed above are a fixed codebook search method and a fixed codebook searcher under the present invention. Although the invention is described through some exemplary embodiments, the invention is not limited to such embodiments. It is apparent that those skilled in the art can make modifications and variations to the invention without departing from the spirit and scope of the invention. The invention is intended to cover the modifications and variations provided that they fall in the scope of protection defined by the following claims or their equivalents.

What is claimed is:

1. A fixed codebook search method for processing in a voice coder, comprising:

initializing a state flag to an initial state;

searching for pulses and calculating a value of a cost function Qk;

modifying the state flag to a non-initial state if the value of Qk increases and replacing an original pulse with a pulse that makes the Qk value increase to obtain a new codebook; and ending a whole search process if the state flag indicates the initial state after completion of an internal loop;

wherein the steps of initializing, searching and modifying are performed in the voice coder.

2. The method of claim 1, wherein the pulse searching comprises at least one internal loop.

3. The method of claim 1, further comprising making a judgment about whether the state flag indicates the initial state after completion of an internal loop, such that ending the whole search process occurs if the state flag indicates the initial state.

4. The method of claim 1, further comprising continuing another internal loop search if the state flag indicates the non-initial state after completion of the internal loop.

5. The method of claim 1, wherein initializing the state flag comprises initializing the state flag to −1, and wherein modifying the state flag to a non-initial state comprises modifying the state flag to 0.

6. A fixed codebook search method for processing in a voice coder, comprising:

initializing a state flag to an initial state;

searching for pulses based on an initial codebook and calculating a value of a cost function Qk;

modifying the state flag to a non-initial state if the value of Qk increases and replacing an original pulse with a pulse that makes the Qk value increase to obtain a new codebook as the initial codebook;

repeating the searching and replacing steps as an internal loop on a selected track; and ending the search method if the state flag indicates the initial state after completion of the internal loop;

wherein the steps of initializing, searching and modifying are performed in a voice coder.

7. The method of claim 6, wherein searching for pulses comprises at least one internal loop.

8. The method of claim 6, further comprising making a judgment about whether the state flag indicates the initial state after completion of the internal loop, so that ending the search method occurs if the state flag indicates the initial state.

9. The method of claim 6, further comprising:

initializing the state flag if the state flag indicates a non-initial state after completion of the internal loop; and executing a next internal loop search.

10. The method of claim 9, further comprising:

if the state flag indicates a non-initial state after completion of the internal loop, determining whether an external iteration ended; and ending the search method if the external iteration is ended or executing the next internal loop search if the external iteration is not ended.

11. The method of claim 6, wherein initializing the state flag comprises initializing the state flag to −1, and wherein modifying the state flag to a non-initial state comprises modifying the state flag to 0.

12. A fixed codebook searcher incorporated in a voice coder, the fixed codebook searcher comprising:

a pulse searching unit of the voice coder configured to search for pulses;

an identifying unit of the voice coder configured to set an initial state flag to an initial state and update the state flag to a non-initial state when a Qk value increases; and a judging unit of the voice coder configured to judge whether the identifying unit indicates the initial state after completion of an internal loop, wherein the pulse searching unit ends a search process if the judging unit determines that the identifying unit indicates the initial state.

* * * * *